United States Patent [19]

Wideman

[11] Patent Number: 4,745,779

[45] **Date of Patent: * May 24, 1988**

[54] RINGS

[76] Inventor: Merle L. Wideman, 30 Wilson Rd., Pinehurst, N.C. 28374

[ * ] Notice: The portion of the term of this patent subsequent to Mar. 4, 2003 has been disclaimed.

[21] Appl. No.: 345,562

[22] Filed: Feb. 4, 1982

Related U.S. Application Data

[63] Continuation-in-part of Ser. No. 188,322, Sep. 18, 1980, abandoned.

[51] Int. Cl.[4] ..... A44C 9/00

[52] U.S. Cl. ..... 63/15; D11/28; D11/29

[58] Field of Search ..... 63/27, 15, 15.6, 15.5; D11/28, 29, 30, 31, 32, 33

[56] References Cited

U.S. PATENT DOCUMENTS

| | | | |
|---|---|---|---|
| D. 244,674 | 6/1977 | Mobell | D11/28 X |
| D. 252,802 | 4/1979 | Lavin | D11/28 X |
| 4,199,962 | 4/1980 | Ambrose | 63/15 |

*Primary Examiner*—Richard J. Johnson

[57] ABSTRACT

A thumb ring construction for use as ornamentation on a hand, including a decorative gem disposed on a support base and a ring shank attached to the support base, the ring shank having undulations with respect to a vertical transverse plane. The ring shank has an axis through the opening of the ring shank mid portions that flare or are inclined relative to a central axis to enhance the fit of the ring shank to a thumb and provide rotational stability of the ring when worn on a thumb.

6 Claims, 2 Drawing Sheets

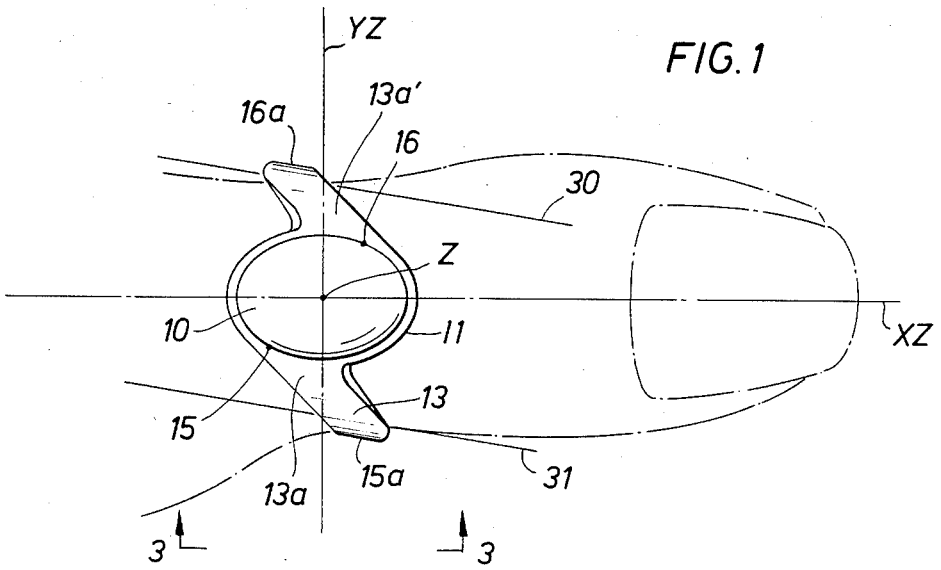
FIG. 1
FIG. 3
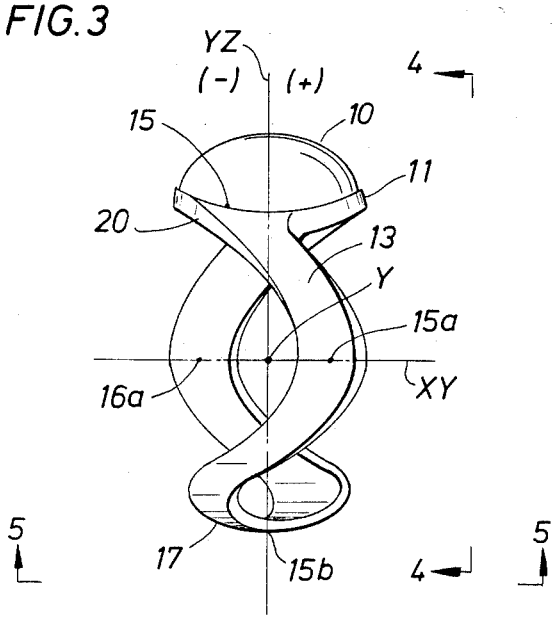
FIG. 4
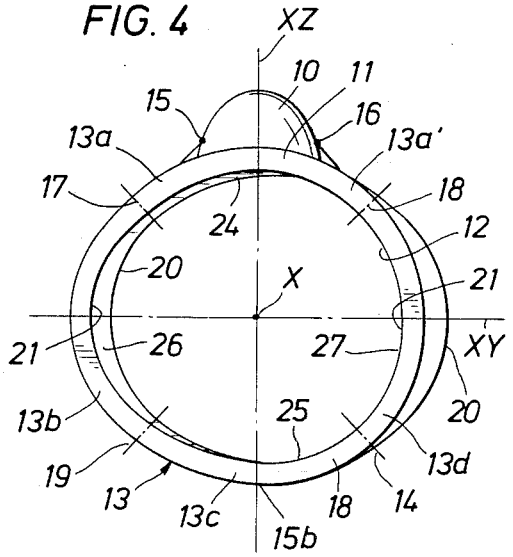
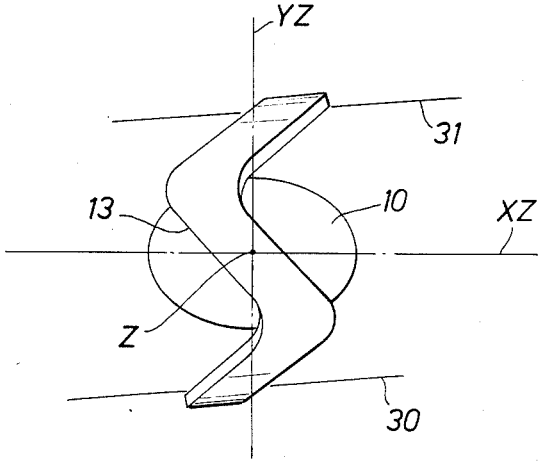
FIG. 5

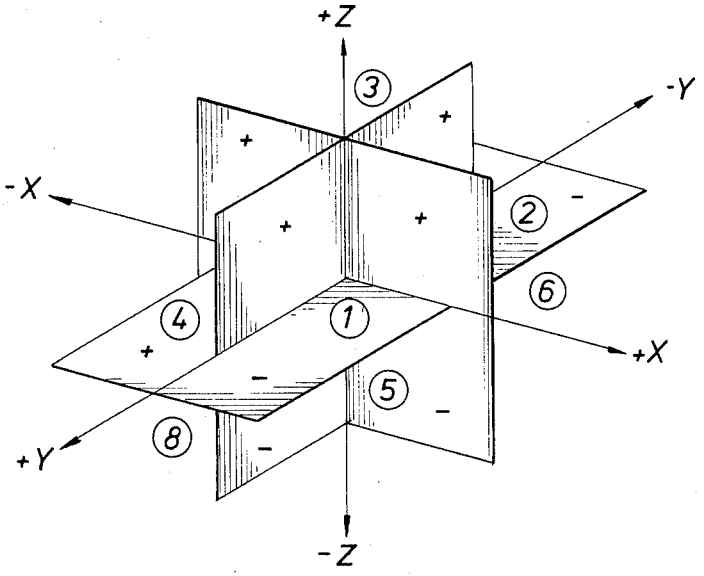
FIG. 2
FIG. 6
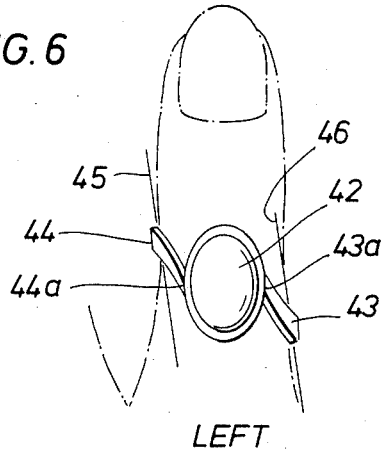
FIG. 7
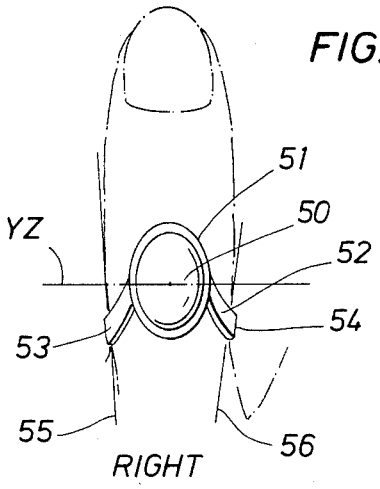
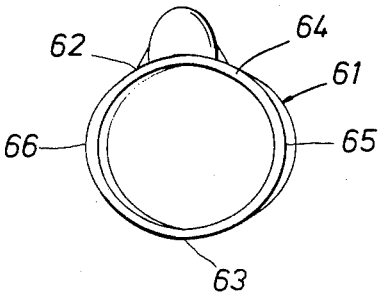
FIG. 8
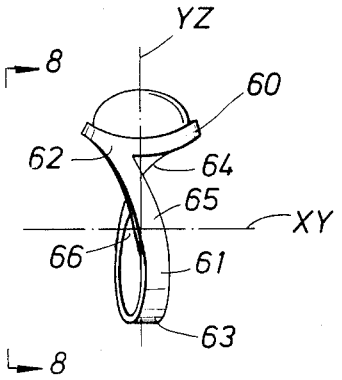
FIG. 9

RINGS

PRIOR APPLICATION

This application is a continuation-in-part of application Ser. No. 188,322, filed Sept. 18, 1980, now abandoned, the priority for the common subject matter which is hereby claimed.

FIELD OF THE INVENTION

This invention relates to thumb rings and more particularly, to construction of thumb rings so as to provide positional stability of a ring on a thumb.

Rings are as old, as perhaps mankind, and have been worn on the fingers and thumb as ornamental objects as an accepted fashionable practice. The principal focus of a ring is upon the jewel or gem and its setting, or the ornamental design of the ring band and there has been little attention paid to the need for providing stability of a ring with respect to rotation on a thumb. Thus, it is a common feature and failing of rings, that a ring tends to rotate about the axis of the thumb while in use and fails to retain positional stability during use. Thus, rings are sometimes cumbersome and awkward when worn during working and restrict the motion and use of the hand. Also, the lack of positional stability detracts from the ornamental features of the jewel in its intended fashion and makes it less desirable.

DESCRIPTION OF PRIOR ART

The pertinent prior art known is as follows:

(1) U.S. Pat. No. 1,950,526. This patent relates to a ring with two criss crossed bands which provide an area of enlargement so that the tendency of rotation is reduced.

(2) U.S. Pat. No. 2,073,228. This patent relates to a finger ring in which the ring is designed to follow the contour of a finger at its base by use of a warped shank.

(3) The Levine U.S. Pat. No. Des. 71,605 shows a base member with a ring shank. The ring shank is attached at opposite connection points on the base member. The shank extends from the connection points in the same direction to an apparent horizontal plane mid point and then reverses to a bottom point which is directly below the connecting points. Thus, the shank is located entirely to one side of the base member and there is no illustration relative to a thumb.

(4) The McCarty U.S. Pat. No. Des. 87,164 is for an ornamental finger ring which has a circular configuration (FIG. 2) and has a uniform band or shank width and no base member. The band appears to have four segments in a circle and respectively offset at 90° with respect to one another.

(5) The Belleza U.S. Pat. No. 184,320 relates to the curvature of aring shank for comfort and for placing the ornament in far enough in back of the second joint of the finger so as to not interfere with the second joint. The rearward projecting portion rests in the bend of the third joint on the inside of the hand. The ring shank extends in the same direction from the connection point at the ornament.

(6) The Mayer U.S. Pat. No. 2,016,679 relates to interlocking complementary ring elements which interfit. The concept is applicable to bracelets, brooches, pendants, clusters, ear rings and similar articles. In FIG. 1, the ring has ends (FIG. 2) and intermediate elements (FIG. 5). The ends preferably have a plane edge and an irregular saw tooth edge. The intermediate elements have saw tooth surfaces. FIG. 7 shows the cross-section of the ring to be circular.

(7) The Shields U.S. Pat. No. 2,084,008 relates to shaping a ring shank to fit a ring finger. As shown in FIG. 3 of the patent, the webbing between the fingers is at different distances or lengths from the tip of the ring finger. The shank of a ring is offset at difference distances from an axis to accomodate the difference in finger webbing so that the setting box is parallel to the axis of the finger. The shank is also offset so that the lower portion of the shank lies in the crease in the juncture of the finger with the palm of the hand. The cross-section of the shank (FIG. 2) is made of two circular segments of unequal radii.

(8) The Nevrous U.S. Pat. No. Des. 243,359 illustrates a circular shaped ring or bracelet with an undulating curvature confined between two vertical planes.

The foregoing prior art represents efforts at preventing ring rotation which are substantially different from the concepts of the present invention.

SUMMARY OF THE PRESENT INVENTION

The present invention involves a ring for use on a thumb and includes a ornamental gem set on base which is attached to a ring shank. The ring shank has a relatively flat interior surface and the shank has undulations about a vertical plane transverse to the longitudinal axis of the gem. The undulations of the shank are such that the shank, at a horizontal plane midway of the opening of the shank, is disposed to either side of the vertical plane and the interior surface is inclined relative to a vertical longitudinal plane to provide a contact surface which conforms to inclinations of a thumb. The direction of inclination of the interior surfaces is a function of a right or left hand design and the interconnection of the shank with the base.

Accordingly, it is an object of the present invention to provide a new and improved ring which, when positioned on a thumb, will hold its rotational position on the thumb.

BRIEF DESCRIPTION OF THE DRAWINGS

The present invention may best be understood when taken in conjunction with the accompanying drawing in which:

FIG. 1 illustrates a top view of a thumb ring of the present invention disposed upon a left hand thumb illustrated in dashed lines;

FIG. 2 is a perspective view of designated octants and planes used in the figures for description purposes;

FIG. 3 is a view from the side of the thumb ring shown in FIG. 1 taken along line 3—3 of FIG. 1;

FIG. 4 is a view taken along line 4—4 of FIG. 3;

FIG. 5 is a view taken along line 5—5 of FIG. 3;

FIG. 6 is a top view of a thumb ring of the present invention disposed on a left hand thumb illustrated in dashed lines with a reversed shank with respect to FIG. 4;

FIG. 7 is a top view of a thumb ring of the present invention disposed on a right hand thumb illustrated in dashed lines with a shank which is located to one side of the gem;

FIG. 8 is a view taken along line 8—8 of FIG. 9; and

FIG. 9 is a side view of another embodiment of a thumb ring.

DESCRIPTION OF PREFERRED EMBODIMENT

The general configuration of a typical thumb is such that, from a top view, it has an outward curvature from the thumbnail to the knuckle and then an inward curvature to the connected hand portion. When viewed from the side, a typical thumb has a generally parallel configuration with a slight inward tapered inclination from the hand toward the nail. In cross-section, the thumb has a sort of flattened oval configuration with the transverse dimension being somewhat greater than the vertical dimension.

Most rings have a circular configuration and ring size measurements are made with respect to the circular configuration necessary for passage over the knuckle of a finger or thumb. The fingers, in contradistinction to the thumb, are more circular in cross-section and thus are more susceptible to accommodating a uniform cross-sectional opening in a ring.

For purposes of description of this invention, certain terminology as noted and used hereafter will be adopted for explanation purposes.

As illustrated in the drawings, a thumb ring includes a gem 10, which in this particular instance is illustrated as having an oval base, is set or mounted in a gem setting oval base 11. The oval base is configured to receive the base portion of the gem 10. With the vertical center of the gem 10 as the center locus of dimensioning with respect to the ring (the "Z" axis, FIG. 1), the longitudinal vertical plane "XZ" through the gem 10 generally bisects a longitudinal vertical plane of a thumb when the ring is on a thumb. A transverse vertical plane "YZ" intersects the gem 10 at the Z axis. The center of the shank which defines the ring opening 12 is located on an "X" axis in the horizontal plane "XY".

The gem setting oval base 11 is integrally attached to a continuous shank member 13. As shown in FIG. 4, for description purposes, the shank member 13 is defined by an upper shank portion 13*a* and 13*a'* which together with base 11 extends in an upper quadrant roughly 45° to either side of the XZ plane. The upper quadrant is defined between dashed lines 17 and 18; a middle shank portion 13*b* in a side quadrant defined between dashed lines 17 and 19, the side quadrant being roughly 45° to either side of the XY plane, a lower shank portion 13*c* in a lower quadrant defined between dashed lines 19 and 14, the lower quadrant being roughly 45° to either side of the XZ plane; and a middle shank portion 13*d* in a side quadrant defined between dashed lines 14 and 18, the side quadrant being roughly 45° to either side of the XY plane. The cross-section through the shank member 13 is generally rectangular and uniform. While the interior and outer surfaces of the shank are shown as parallel, the interior or inner surface of the shank portions 13 (*a–d*) is generally flat or straight. The outer surface of the shank portions 13 (*a–d*) may have an artistic curvature, if desired.

Referring now to FIG. 2, for spacial designations the octants are defined as follows:

| Octant | Plane XY | Plane XZ | Plane YZ |
|---|---|---|---|
| 1 | ++ | ++ | ++ |
| 2 | +− | ++ | −+ |
| 3 | −− | −+ | −+ |
| 4 | −+ | −+ | ++ |
| 5 | ++ | +− | +− |
| 6 | +− | +− | −− |
| 7 | −− | −− | −− |
| 8 | −+ | −− | +− |

Where the plus (+) and minus (−) signs indicate direction with respect to the intersection of axis X, Y and Z. The upper octants above the XY plane are numbered 1–4 (FIG. 1) while the lower octants below the XY plane are numbered 5–8 (FIG. 5). The shank member 13 beginning at point 15 on the base 11 (in FIG. 1) passes through octants 4 and 1; octants 1 and 5; octants 5 and 8; octant 8 and 6; octant 6 and 7; octants 7 and 3; and octants 3 and 2 to the point 16 on the base 11 (FIG. 1).

The gem setting base 11 supports the gem 10 and is symetrical with respect to the YZ and XZ planes where the XZ plane is aligned generally longitudinally with respect to the thumb. The upper shank portion 13*a* is connected at one end to the gem setting base 11 at an effective location approximately one-half of the distance from the YZ plane to the end of the gem on the minus X axis. Similarly, the other upper shank portion 13*a'* is connected at one end to the gem setting base 11 at an effective location approximately one-half the distance from the XZ plane to the end of the gem on the plus X axis.

The effective locations of interconnection are illustrated by the points 15 and 16 in FIG. 1 of the drawing. The upper shank portion 13*a* and 13*a'* respectively join the middle shank portions 13*b* and 13*d* and the middle shank portion 13*b* and 13*d* interconnect with the lower shank portions 13*c*. The point 15 of the upper shank portion 13*a* at the base 11 is located generally in the minus X direction a distance approximately equal to one-half the distance from the YZ plane to the end of the gem and base on the minus X axis. (See FIG. 1). At the transverse XY plane, (See FIGS. 3 and 4) the mid-point 15*a* of the middle shank portion 13*b* is extended in the plus X direction a distance approximately equal to one-half the distance from the YZ plane to the end of the gem and base on the plus X axis.

The lower shank portion 13*c* is offset with its mid-point 15*b* which lies on the XZ plane. The middle shank portion 13*d* has its mid-point 16*a* extended in the minus X direction a distance approximately equal to one-half the distance from the YZ plane to the end of the gem of the minus X axis. The point 16 of the upper shank portion 13*a'* at the base 11 is generally located in the plus X direction a distance approximately equal to one-half of the distance from the YZ plane to the end of the gem and base on the plus X axis.

As is apparent from the description and drawings, the shank member 13 undulates about the vertical and transverse plane YZ and the undulations extend between a location to either side of the ring base with respect to the YZ plane with the lower shank portion 15*b* passing through the vertical Z axis. The shank undulations are such that the shank is attached to the ring base on opposite sides of the YZ plane.

As illustrated in FIG. 4, (and shown in FIG. 1 by lines 30 and 31) the interior surface of the middle shank portions 13*b* and 13*d* are angularly inclined or flared with respect to the vertical plane XZ in the same sense of direction. As shown in FIG. 4, the inclinations of both middle shank portions 13*b* and 13*d* lying in the XY plane extend from a rearward edge surface 20 to a forward edge surface 21. Thus, one rearward edge 20 of the shank on one side of the XZ plane is closer to the X axis than a corresponding forward edge 21, and on an opposite side of the XZ plane, one forward edge 21 is closer to the X axis than a corresponding rearward edge 20. The inclination of the middle shanks portions **13*b* and 13*d* is generally proportioned to general inclination at the transverse cross-section of a thumb where the shank contacts the thumb. In addition, the mid points 15*a* and 16*a* of the shank are curvilinearly proportioned to the general curvature of the side portions of a thumb for enhancing the fit of the ring on a thumb. Thus, the middle shank portions 13*b* and 13*d* conform to the curvature of the sides of a thumb and the inclinations 30 and 31** provide an inner surface contact of the shank with the thumb which inhibits rotation of the ring.

As shown in FIG. 4, the cross-sectional opening surrounded by an edge surface 20 or 21 is not an elipse or an oval but rather has upper and lower curved portions 24, 25 with a smaller radius of curvature than the side curved portions, 26, 27. The curved portions of the shank are smooth but non-circular and generally proportioned to the general curvature of a thumb. Because of the mid-points **15*a* and 16*a*** of the middle shank portions are located to either side of the YZ plane, the ring shank easily slides over a thumb knuckle, and once past the knuckle, adapts to the configuration of the thumb surface.

Viewing the ring in FIG. 5, the inclinations 30 and 31 of the mid shank portions are also apparent. The inclinations 30 and 31 also permit the ring to be rotated with respect to the vertical axis Z while the ring is placed on a thumb. The rotation of the ring permits the ring to slide over the knuckle or joint to a location between the knuckle and the hand. At the location between the knuckle and the hand, the inclinations 30 and 31 of the ring shank generally conform to the thumb surface with the longitudinal axis of the gem in line with the vertical longitudinal axis XZ through the thumb.

As shown in FIG. 6 a ring for a left thumb can be fashioned by the use of a shank which is interconnected at the mid-point **43*a* and 44*a* of a base 42. In this instance, the interior flat surfaces of the middle shank portions of the shank 44 have inclinations 45, 46 with respect to the XZ plane but in an opposite direction to the respective inclinations 30 and 31 of FIG. 1**.

A right hand thumb ring 50 is illustrated in FIG. 7 wherein a gem base 51 is connected to a ring shank 52 at the mid-points of the base 51. The shank 52 has both of its side portions 53 and 54 located to one side of the of the base 51. In this configuration, the inclinations 55 and 56 of the side portions 53 and 54 are converging so that the inner surfaces of the mid shank portions conforms to the curvature of the thumb.

In FIGS. 8 and 9, the ring base 60 is connected to a ring shank 61 which extends between a connection point 62 to a bottom point 63 which crosses under the base along the YZ plane and then curves upwardly to another connection point 64. The middle shank portions 65 and 66 of the interior surface of the shank along the XZ plane are provided with inclinations as described heretofore.

I claim:

1. A ring for use on a thumb member comprising:

a base member, an ornamental gem on said base member, said base member and said gem being bisected by a vertical longitudinally extending plane so that when the base member is disposed on a thumb member there is a general longitudinal coincidence of said vertical plane with a vertical longitudinal plane which extends through and bisects the thumb member;

ring shank means attached to said base member on opposite sides of said vertical longitudinal plane and on opposite sides of a transverse vertical plane which bisects said base member, said ring shank means defining an opening for receiving a thumb member, said ring shank means having a generally flat interior surface for contact with the surface of a thumb member; and said ring shank means having mid-height ring shank portions with inclinations of said flat interior surfaces with respect to said vertical longitudinal plane, said mid-height ring shank portions intersecting a horizontal transverse plane disposed midway of said opening defined by said ring shank means, said inclinations of said mid-height portions serving the purpose of bringing the flat interior surface of said shank means into contact with the surface of a thumb member.

2. The ring as set forth in claim 1 wherein said inclinations are in the same sense of direction.

3. The ring as set forth in claim 1 wherein said ring shank means has undulations with respect to said transverse vertical plane which intersects said vertical longitudinal plane and bisects said base member.

4. The ring as set forth in claim 1 wherein said opening has a vertical dimension different from the horizontal dimension of said opening to define an out-of-round opening shaped to enhance the contact of said ring shank means with a thumb surface.

5. The ring as set forth in claim 2 wherein said opening has a vertical dimension different from the horizontal dimension of said opening to define an out-of-round opening shaped to enhance the contact of the shank means with a thumb surface.

6. A ring for use on a thumb member comprising:

a base member;

an ornamental gem mounted on said base member, said base member and said gem being bisected by a vertically extending longitudinal plane so that when the base member and gem are disposed on a thumb member there is a general longitudinal coincidence with a longitudinal vertical plane which extends through and bisects the thumb member;

ring shank means attached to said base member on opposite sides of said vertical longitudinal plane and on opposite sides of a transverse vertical plane which bisects said base member, said ring shank means having a generally flat interior surface for contact with the surface of a thumb member;

said ring shank means having a curvature which, when viewed from one side of the ring has a generally curved configuration and, when viewed from the other side of the ring, has a generally curved configuration which is reversed with respect to the said one side configuration and, when viewed from the bottom of the ring has a generally curved configuration joining the side curved configurations thereby defining a ring shank means with undulations; and said ring shank means having mid-height ring shank portions with inclinations of said flat interior surfaces with respect to said vertical longitudinal plane, said mid-height ring shank portions intersecting a horizontal transverse plane disposed midway of said opening defined by said ring shank means, said inclinations of said mid-height portions serving the purpose of bringing the flat interior surface of said shank means into contact with the surface of a thumb member.

* * * * *